US010563664B2

(12) United States Patent
Springer et al.

(10) Patent No.: US 10,563,664 B2
(45) Date of Patent: Feb. 18, 2020

(54) FAN IMPELLER AND RADIATOR FAN MODULE

(71) Applicant: BROSE FAHRZEUGTEILE GMBH & CO. KOMMANDITGESELLSCHAFT, WÜRZBURG, Würzburg (DE)

(72) Inventors: Nils Springer, Oldenburg (DE); Michael Mauss, Oldenburg (DE); Frank Kameier, Düsseldorf (DE); Gi-Don Na, Düsseldorf (DE)

(73) Assignees: Brose Fahrzeugteile GmbH & Co. Kommanditgesellschaft, Würzburg, Würzburg (DE); Hochschule Düsseldorf University of Applied Sciences, Düsseldorf (DE)

( * ) Notice: Subject to any disclaimer, the term of this patent is extended or adjusted under 35 U.S.C. 154(b) by 27 days.

(21) Appl. No.: 15/744,132

(22) PCT Filed: Jul. 29, 2016

(86) PCT No.: PCT/EP2016/068215
§ 371 (c)(1),
(2) Date: Jan. 12, 2018

(87) PCT Pub. No.: WO2017/017264
PCT Pub. Date: Feb. 2, 2017

(65) Prior Publication Data

US 2018/0202452 A1 Jul. 19, 2018

(30) Foreign Application Priority Data

Jul. 29, 2015 (DE) ..... 10 2015 214 356

(51) Int. Cl.
*F04D 29/32* (2006.01)
*F04D 29/16* (2006.01)
(Continued)

(52) U.S. Cl.
CPC ..... *F04D 29/164* (2013.01); *F01P 5/06* (2013.01); *F01P 11/10* (2013.01); *F04D 29/326* (2013.01);
(Continued)

(58) Field of Classification Search
CPC ..... F04D 29/326; F04D 29/38; F04D 29/384; F04D 19/002
(Continued)

(56) References Cited

U.S. PATENT DOCUMENTS 1,370,083 A * 3/1921 Blackmore ..... F01P 5/02 126/215
5,489,186 A * 2/1996 Yapp ..... F01D 5/141 415/208.3
(Continued)

FOREIGN PATENT DOCUMENTS

DE 102008046508 A1 3/2010
DE 102012207552 A1 11/2012
(Continued)

OTHER PUBLICATIONS

English Translation of International Preliminary Report on Patentability in PCT/EP2016/068215, dated Jan. 30, 2018.
(Continued)

*Primary Examiner* — Richard A Edgar
(74) *Attorney, Agent, or Firm* — Manelli Selter PLLC; Edward Stemberger

(57) ABSTRACT

The invention relates to a fan impeller (5) for a radiator fan module (1) in a motor vehicle as well as to a radiator fan module, the fan impeller comprising: a hub (8), a shroud (9), a plurality of blades (7) that extend from the hub (8) outward and are connected to each other via the shroud (9), and a plurality of streamlining fins (16) which are located between the blades (7), on the bottom side (12) of the shroud (9).

16 Claims, 5 Drawing Sheets

(51) Int. Cl.

| | |
|---|---|
| ***F01P 5/06*** | (2006.01) |
| ***F01P 11/10*** | (2006.01) |
| ***F04D 29/52*** | (2006.01) |
| ***F04D 29/66*** | (2006.01) |

(52) U.S. Cl.
CPC ..... *F04D 29/327* (2013.01); *F04D 29/526* (2013.01); *F04D 29/667* (2013.01)

(58) Field of Classification Search
USPC ..... 416/189, 194, 195, 169 A
See application file for complete search history.

(56) References Cited

U.S. PATENT DOCUMENTS

| | | | | |
|---|---|---|---|---|
| 5,810,555 | A * | 9/1998 | Savage | F04D 29/384 416/189 |
| 8,484,925 | B2 * | 7/2013 | Daas | B66C 23/70 52/645 |

FOREIGN PATENT DOCUMENTS

| | | | | |
|---|---|---|---|---|
| EP | 1813820 | A1 * | 8/2007 | F04D 29/326 |
| EP | 1813820 | A1 | 8/2007 | |
| EP | 2886873 | A1 | 6/2015 | |
| JP | 2003094494 | A | 4/2003 | |
| WO | 2016072068 | A1 | 5/2016 | |

OTHER PUBLICATIONS

International Search Report in PCT/EP2016/068215 dated Oct. 14, 2016.

* cited by examiner

FAN IMPELLER AND RADIATOR FAN MODULE

FIELD OF THE INVENTION

The present invention relates to a fan impeller for a radiator fan module and to a radiator fan module comprising a fan impeller.

TECHNICAL BACKGROUND

Currently, radiator fan modules are used to cool the engine in motor vehicles. A radiator fan module typically consists of a fan impeller, in which a motor to drive the fan impeller is arranged, and a frame which comprises mounting struts for fastening the fan impeller.

The fan impeller of a radiator fan module is generally designed to produce an air flow with which the heat generated by the engine of a motor vehicle is to be carried away. Radiator fan modules have what is known as a gap flow in addition to the main flow. The gap flow refers to the flow which forms between the fan impeller and the frame due to the pressure differential and which tends to swirl due to the rotation of the fan impeller. The swirling gap flow works against the main flow, leading to a negative impact on the flow behaviour of the radiator fan module. This defective flow sometimes leads to a very high level of undesirable noise being generated.

SUMMARY OF THE INVENTION

Against this background, the problem addressed by the present invention is that of providing an improved fan impeller for a radiator fan module for a motor vehicle.

Accordingly, a fan impeller for a radiator fan module of a motor vehicle is provided, comprising: a hub, a fan impeller outer ring, a plurality of fan impeller blades, which extend outwards from the hub and are interconnected by the fan impeller outer ring, and a plurality of flow fins, which are arranged on the underside of the outer ring between the fan impeller blades.

The basic concept of the invention is to provide flow fins on the fan impeller outer ring. The flow fins do not have an aerodynamic profile like the fan impeller blades. The flow fins deflect the reverse flow through the gap between the fan impeller outer ring and the frame such that it merges with the main flow in a manner that is as free of turbulence and as smooth as possible.

This is advantageous in that it results in significant noise reduction in a radiator fan module comprising a fan impeller of this type. Since the flow fins do not have an aerodynamic profile and accordingly do not form additional fan blades, the flow fins do not increase, or only slightly increase, the torque of the fan impeller.

As a result, the aerodynamic efficiency of the fan impeller remains unchanged or substantially unchanged. Therefore, the acoustics of the radiator fan module can be improved by the flow fins of the fan impeller without any negative impact on the aerodynamic properties of the fan impeller.

Furthermore, a radiator fan module for a motor vehicle comprising a fan impeller of this type is provided.

Advantageous embodiments and developments will become apparent from the additional dependent claims and from the description with reference to the figures of the drawings.

In an advantageous embodiment according to the invention, at least one flow fin is arranged between two adjacent fan impeller blades. In principle, however, it is also possible, depending on the function and purpose, to also arrange two and more flow fins between two adjacent fan impeller blades, for example in succession and/or beside one another in the circumferential direction. If two flow fins are provided between two adjacent fan impeller blades, for example, these flow fins can thus e.g. be arranged such that they form a channel that further improves the flow guidance in the blade tip region of the fan impeller blades.

In another embodiment according to the invention, the at least one flow fin overlaps at least in part with at least one of the two adjacent fan impeller blades. Likewise, the at least one flow fin can also be arranged such that it does not overlap at least in part with either of the two adjacent fan impeller blades.

The advantage of an overlap is the formation of a flow channel between the blade and flow fin, which leads to improved flow around the blade tip. An advantage of there not being an overlap, however, is that it can be manufactured effectively using injection moulding.

In another embodiment according to the invention, the flow fins are arranged in the circumferential direction of the fan impeller outer ring and/or obliquely to the circumferential direction of the fan impeller outer ring on the underside thereof.

According to an embodiment according to the invention, the fan impeller blades each have an inner end and an outer end, the fan impeller blades each being arranged on the hub at the inner end thereof and on the underside of the fan impeller outer ring at the outer end thereof. Here, the flow fins and the outer ends of the fan impeller blades may be arranged in parallel with one another in the circumferential direction. Likewise, the flow fins and/or the outer ends of the fan impeller blades may be arranged on a common line in the circumferential direction of the fan impeller outer ring.

In an embodiment according to the invention, the flow fins and the outer ends of the fan impeller blades may be arranged obliquely to the circumferential direction of the fan impeller outer ring. In this case, the flow fins and the outer ends of the fan impeller blades may be arranged in the same oblique position relative to the circumferential direction or in a different oblique position relative to the circumferential direction of the fan impeller outer ring. The angle of the oblique position of the flow fin or the blade has an effect on the flow topology in the blade tip region.

According to an embodiment of the invention, the fan impeller is e.g. integrally formed as an injection-moulded part. As a result, the fan impeller can be very simply and cost-effectively manufactured to have additional flow fins. In another embodiment according to the invention, the flow fins or a combination of the fan impeller outer ring and the flow fins are fastened to the rest of the fan impeller as a separate component. A combination of the fan impeller outer ring and the flow fins can be arranged on an existing fan impeller very simply by means of adhesive bonding or friction welding. Individual parts may for example be manufactured using 3D printing. Injection moulding is the most common manufacturing option for the complete part.

In a preferred embodiment of the invention, the flow fins are each designed as flat plates having a constant thickness. The thickness of each flow fin thus does not vary, but rather is continuously constant or constant in part. In another embodiment of the invention (not shown), the flow fins are designed as substantially or almost flat plates, but have at least one portion or region in which the thickness of the flow fin is not constant, but varies.

In one embodiment of the invention, the ratio of the height h of each flow fin to the length l of the flow fin is preferably in a range of between 5%<h/l<25%. In this range, there is a particularly favourable ratio of material cost to acoustic effect. Owing to the flow fins, the reverse flow through the gap between the fan impeller outer ring and the frame is deflected such that it merges with the main flow in a manner that is as free of turbulence as possible. As a result, such a fan impeller according to the invention can significantly reduce noise in a radiator fan module.

In another embodiment of the invention, the ratio of the height h of each flow fin to the spacing H of the fan impeller outer ring from the outside of the hub is in a range of preferably 3%<h/H<20%. In this range, there is likewise a particularly favourable ratio of material cost to acoustic effect.

According to another embodiment of the invention, each flow fin for example has a curved and/or rectangular contour. The flow fin may e.g. have at least one curved portion and/or at least one rectangular portion.

The above embodiments and developments can be combined with one another as desired, where appropriate. Further possible embodiments, developments and implementations of the invention also include combinations of features of the invention that have been previously described or are described in the following with respect to the embodiments, even if not explicitly mentioned. In particular, a person skilled in the art will also add individual aspects as improvements or additions to the relevant basic form of the present invention.

DESCRIPTION OF THE DRAWINGS

The present invention is explained below in greater detail with reference to the embodiments specified in the schematic figures of the drawings, in which.

The accompanying drawings are intended to provide further understanding of the embodiments of the invention. They illustrate embodiments and, together with the description, are used to explain principles and concepts of the invention. Other embodiments and many of the mentioned advantages will become apparent from the drawings. The elements of the drawings are not necessarily shown to scale relative to one another.

In the figures of the drawings, identical, functionally identical and identically operating elements, features and components are provided in each case with the same reference signs, unless indicated otherwise.

DESCRIPTION OF EMBODIMENTS

Figure 1:
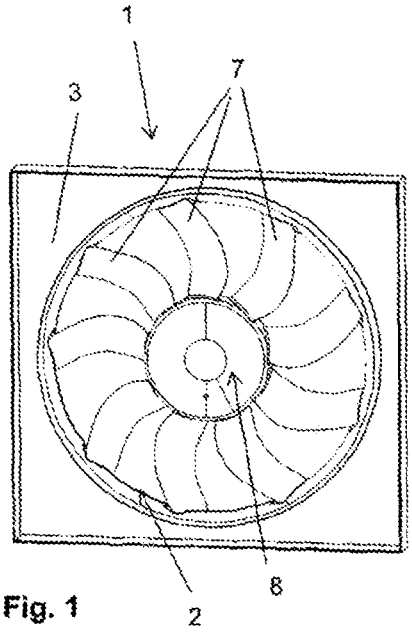
FIG. 1 is a perspective front view of a radiator fan module.

FIG. 1 is a perspective front view of a radiator fan module 1. The radiator fan module 1 comprises a frame 3, which has a substantially rectangular form in the example shown in FIG. 1. A recess or opening is provided within the frame 3, in which the fan impeller 2 comprising fan impeller blades 7 and a hub 8 is arranged. The fan impeller 2 is fastened to the frame 3 by means of mounting struts (not shown).

A fan impeller according to the invention described in the following with reference to FIGS. 2 to 6 can be used in such an example of a radiator fan module 1. The invention is, however, not restricted to the specific radiator fan module, as shown in FIG. 1.

Instead, the fan impeller according to the invention can be used in any suitable radiator fan module.

Figure 2:
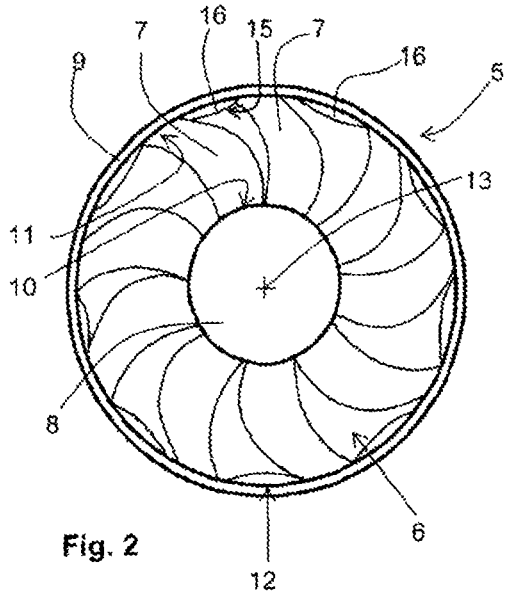
FIG. 2 is a front view of a fan impeller according to an embodiment of the invention.

FIG. 2 is a purely schematic and highly simplified view of an embodiment of a fan impeller 5 according to the invention. In FIG. 2, the fan impeller 5 is shown from its front side 6, from which point air is drawn in via the fan impeller 5, as was previously the case for the fan impeller shown in FIG. 1.

The fan impeller 5 in this embodiment shown in FIG. 2 comprises a plurality of fan impeller blades 7 which extend outwards, i.e. in the radial direction, from a hub 8. Here, the hub 8 is connected to a fan impeller outer ring 9 via the fan impeller blades 7. Here, the fan impeller blades 7 are each connected to the hub 8 at the inner end 10 thereof and to the fan impeller outer ring 9, and in particular to its underside 12, at the outer end 11 thereof.

Furthermore, a motor is provided in the hub 8 that drives the fan impeller 5 such that said fan impeller rotates about its longitudinal axis 13 as a rotational axis. Here, with its fan impeller outer ring 9 and the frame, the fan impeller 5 forms a gap through which air drawn in through the radiator fan module on the front side of the fan impeller 5 can flow back. The gap between the fan impeller outer ring 9 and the frame is shown by way of example in FIG. 3 in subsequent sectional views.

In the fan impeller 5 according to the invention, as shown by way of example in FIG. 2, additional projections 15 are provided on the underside of the fan impeller outer ring 12.

The projections 15 are in the form of flow fins 16 or flow ribs. Furthermore, the projections in the form of flow fins 16 or flow ribs are provided between the fan impeller blades 7 on the fan impeller blade outer ring 9. In the embodiment shown in FIG. 2, at least one flow fin 16 or flow rib is provided e.g. between each two adjacent fan impeller blades 7 of the relevant fan impeller 5; however, a plurality of or at least two flow fins may also be arranged between two adjacent fan impeller blades.

Owing to the flow fins 16, the reverse flow through the gap between the fan impeller outer ring 12 and the frame is deflected such that it merges with the main flow in a manner that is as free of turbulence as possible. As a result, such a fan impeller 5 according to the invention can significantly reduce noise in a radiator fan module.

Figure 10:
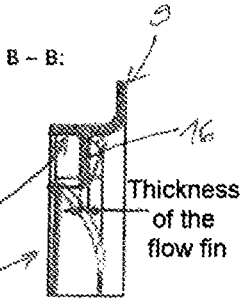
FIG. 10 is a sectional view B-B of the fan impeller according to FIG. 8.
Figure 11:
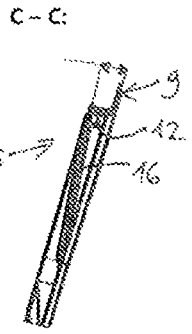
FIG. 11 is a sectional view C-C of the fan impeller according to FIG. 8.

As shown in subsequent graphs in FIGS. 10 and 11, a reduction of approximately 4 dB(A) may for example be achieved over the entire rotational speed range of the radiator fan module.

In the embodiments shown, the flow fins 16 do not have an aerodynamic profile, and thus are not additional fan blades 7. The flow fins 16 are instead designed as planar curved portions. The flow fins 16 aim to improve the acoustics, and the geometry thereof does not have an aerodynamic profile. Therefore, said fins do not increase the torque of the fan impeller 5, or only increase it marginally. The aerodynamic efficiency also remains unchanged or substantially unchanged. Therefore, the acoustics of the radiator fan module can be improved by such a fan impeller 5 according to the invention without any negative impact on the aerodynamic properties of the fan impeller 5. In principle, however, a fan impeller according to the invention comprising flow fins (not shown) that have an aerodynamic profile may be provided. Likewise, in another fan impeller according to the invention, flow fins without an aerodynamic profile and flow fins with an aerodynamic profile may also be provided, depending on the function and purpose.

Figure 3:
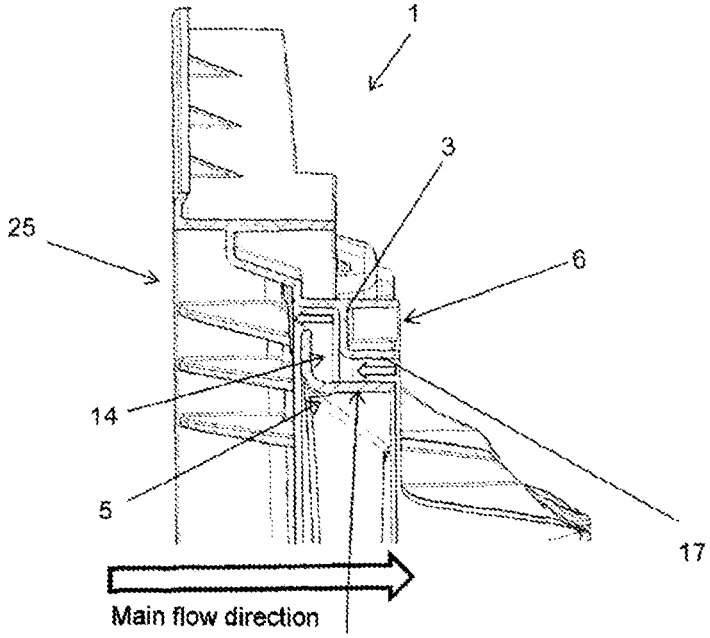
FIG. 3 is a sectional view through a frame and a fan impeller according to the invention received in the frame.

FIG. 3 is a sectional view through a frame 3 and a fan impeller 5 according to the invention received in the opening 17 in the frame 3. As described previously, together with the frame 3, the fan impeller outer ring 9 forms a gap 14, through which air drawn in by the radiator fan module 1 on the front side 6 can flow back. The reverse flow of the air to the rear side 25 of the fan impeller 5 is indicated in FIG. 5 by arrows.

Figure 4:
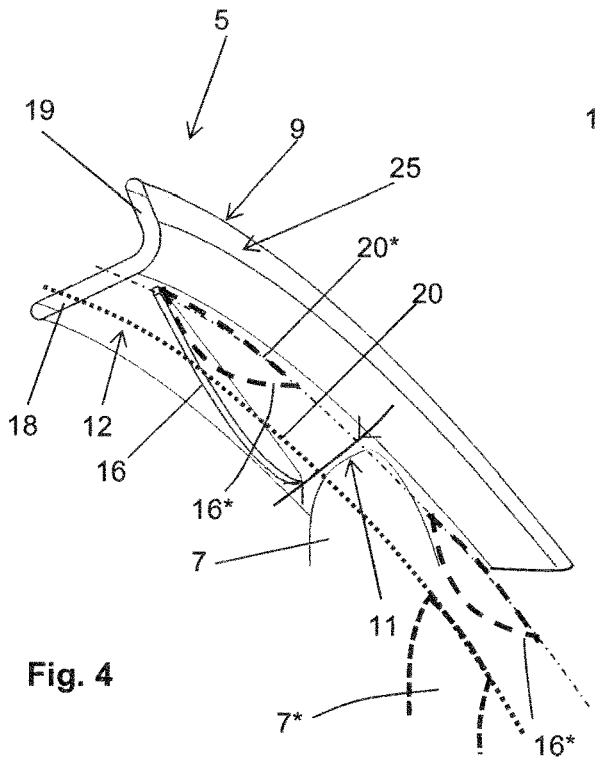
FIG. 4 is a perspective view of a detail of the fan impeller according to FIG. 2.
Figure 5:
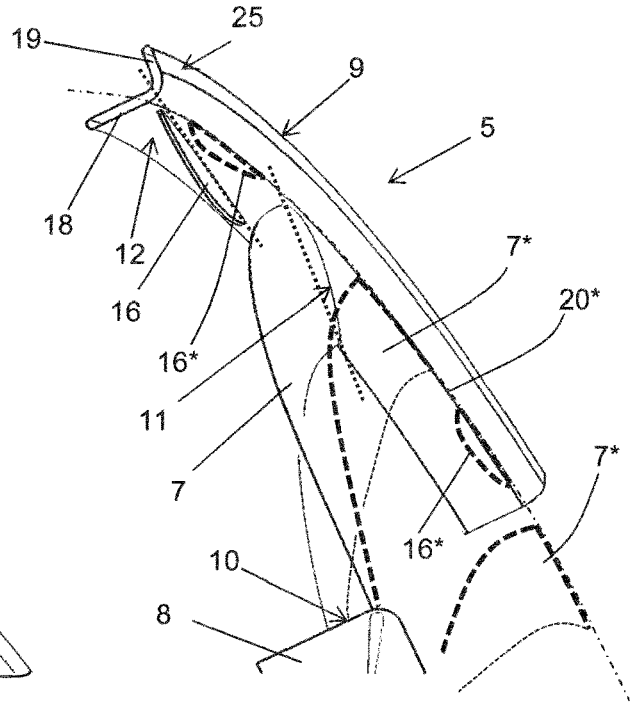
FIG. 5 shows another detail of the fan impeller according to FIG. 2.
Figure 6:
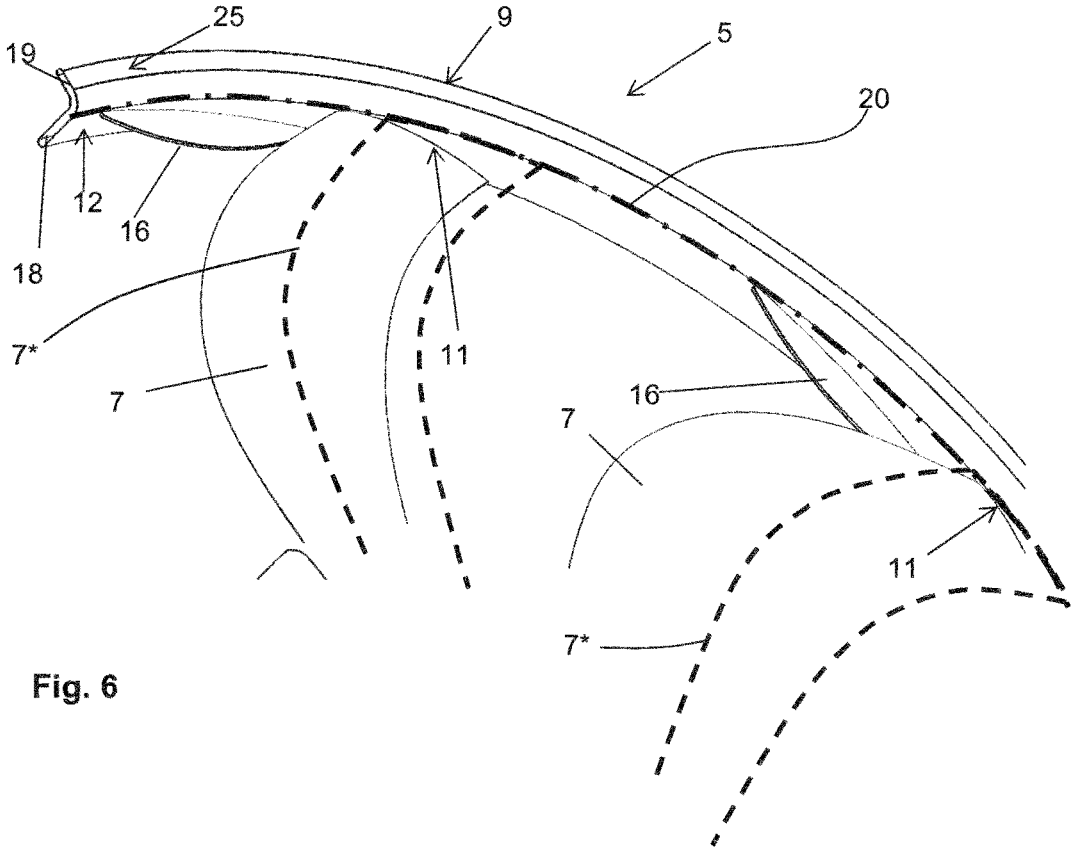
FIG. 6 shows another detail of the fan impeller according to FIG. 2.

FIGS. 4, 5 and 6 are different perspective sectional views of the fan impeller 5 according to FIG. 2 from the rear side 25.

The fan impeller outer ring 9 comprises a first portion or base portion 18 which extends in the longitudinal direction or substantially in the longitudinal direction of the fan impeller 5. Here, the fan impeller outer ring 9 comprises an additional or second portion 19 extending radially or substantially radially outwards from the base portion 18, as shown in the embodiment in FIGS. 4, 5 and 6. This second portion 19 can be omitted, however. The flow fins also retain their positive effect on acoustics without the second portion 19.

The fan impeller blades 7, 7*, at their outer ends 11, and additionally the flow fins 16, 16* are fastened to the underside 12 or the inner circumference of the fan impeller outer ring 9 or the base portion 18 thereof. In this case, the flow fins 16, 16* may be integrally formed with the fan impeller outer ring 9 or may be fastened thereto as a separate part, e.g. by latching, bonding, pinning and/or friction welding etc., or any other suitable method.

In this case, the flow fins 16, 16* are e.g. convex or curved, for example in the form of curved ribs as shown in FIGS. 3, 4 and 6 to 8, and are each arranged between two adjacent fan impeller blades 7 on the underside 12 of the fan impeller outer ring 9 or the base portion 18 thereof.

In embodiments of the invention, the flow fins 16*, e.g. flow fins 16* indicated with a dashed line in FIGS. 4, 5 and 6, may be positioned in the circumferential direction of the fan impeller outer ring 9 or the flow fins 16, e.g. flow fins 16 indicated with a continuous line in FIGS. 4, 5 and 6 may be positioned obliquely to the circumferential direction of the fan impeller outer ring 9. FIG. 4 shows two examples of a circle 20, 20* formed by the fan impeller outer ring 9 having its centre point on the rotational axis of the fan impeller 5 by way of a dashed-dotted line and a dotted line.

In this case, in other embodiments of the invention, the flow fins 16* and the outer ends 11 of the fan impeller blades 7* may be arranged in parallel with one another e.g. in the circumferential direction or may be arranged obliquely to the circumferential direction. Here, for example the flow fins 16*, indicated with a dashed line in FIG. 4, may be arranged on the dashed-dotted line 20* in FIG. 4 in the circumferential direction and the outer ends 11 of the fan impeller blades 7, indicated with a dashed line in FIG. 4, may be arranged on the dotted line 20, or vice versa. In this way, the flow fins 16 and the outer ends 11 of the fan impeller blades 7 extend in parallel with one another and furthermore both in the circumferential direction. In principle, in another embodiment of the invention, the flow fins 16 and the respective outer ends 11 of the fan impeller blades 7 may be arranged in parallel with one another and obliquely to the circumferential direction of fan impeller outer ring.

In yet another embodiment of the fan impeller according to the invention, the flow fins 16* indicated with a dashed line in FIGS. 4 and 5 and/or the outer ends 11 of the fan impeller blades 7*, indicated with a dashed line in FIGS. 4, 5 and 6, may be arranged on a common line, e.g. in FIG. 4 the flow fins 16* are arranged on the dashed-dotted line 20* and the fan impeller blades 7*are arranged on the dotted line 20 in FIG. 4, in the circumferential direction of the fan impeller outer ring 9, further in FIG. 5 the flow fins 16* are arranged on the dashed-dotted line 20* and the fan impeller blades 7* are also arranged on the dashed-dotted line 20 in the circumferential direction of the fan impeller outer ring 9 in FIG. 5. Furthermore, in FIG. 6 the fan impeller blades 7* are arranged on the dashed-dotted line 20 in the circumferential direction of the fan impeller outer ring 9.

In other embodiments of the invention, instead of being in parallel with one another as illustrated by the flow fins 16* and the fan impeller blades 7* in FIGS. 4 and 5, the flow fins 16 and the outer ends 11 of the fan impeller blades 7 may also be arranged in different oblique positions relative to the circumferential direction of the fan impeller outer ring 9, as shown in FIG. 5 by a dotted line in a highly simplified and purely schematic manner.

Figure 8:
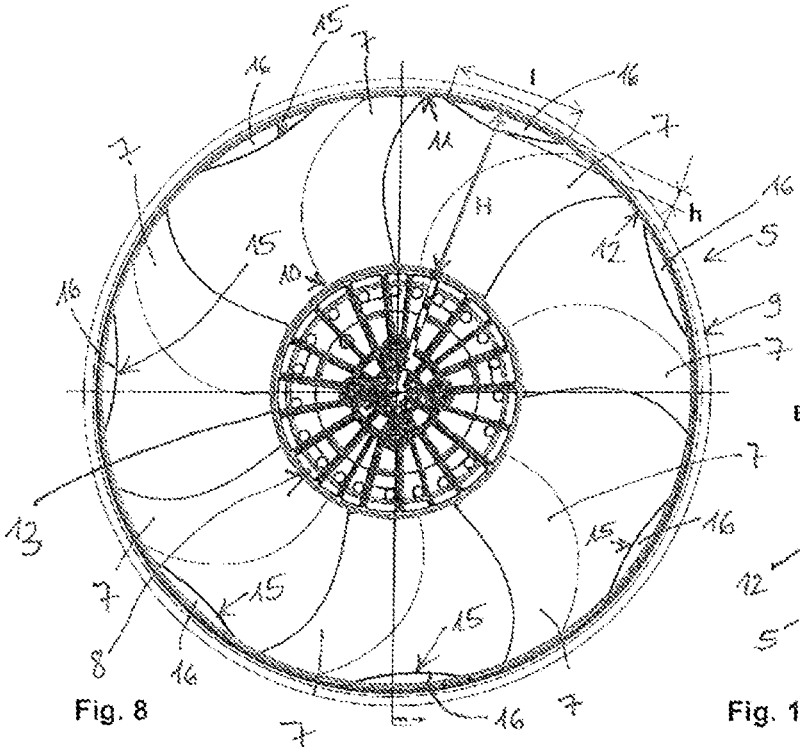
FIG. 8 is a rear view of a fan impeller according to an embodiment of the invention.

In embodiments of the invention, the flow fins 16 may be designed such that they do not overlap with any adjacent impeller blades 11, or such that they overlap at least in part with at least one adjacent impeller blade 11, as shown in FIG. 8.

The fan impeller 5 shown in each of FIG. 2-6 may for example be designed as an integral injection-moulded part. Furthermore, it is also possible to design the fan impeller outer ring 9 e.g. together with the flow fins 16 as a separate part which can be connected to a conventional fan impeller.

For example, the fan impeller outer ring 9 can be connected to the fan impeller e.g. by means of adhesive bonding and/or friction welding etc.

Figure 7:
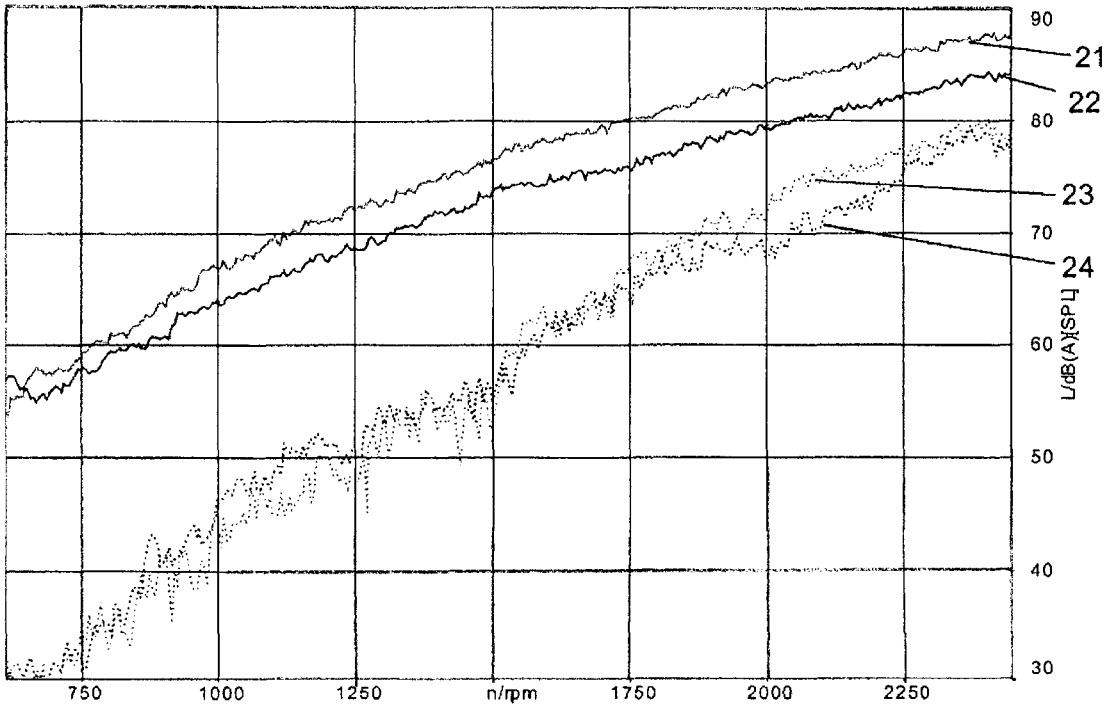
FIG. 7 is a graph which shows a curve of a total level and of the rotational noise of a conventional fan impeller and of a fan impeller according to the invention as a function of the rotational speed.

Furthermore, FIG. 7 is a graph which shows a curve 21 of the total level of the conventional fan impeller and a corresponding curve 22 of the fan impeller according to the invention from FIG. 2 as a function of the rotational speed of the fan impeller when the respective fan impellers start up. This graph also shows the curve 23 of the rotational noise for the conventional fan impeller and the corresponding curve 24 for the fan impeller according to the invention from FIG. 2.

As can be seen from FIG. 7, the total level of the fan impeller according to the invention decreases by up to 4 dB compared with the conventional fan impeller. The rotational noise of the fan impeller according to the invention in turn remains almost unchanged compared with the conventional fan impeller.

Figure 9:
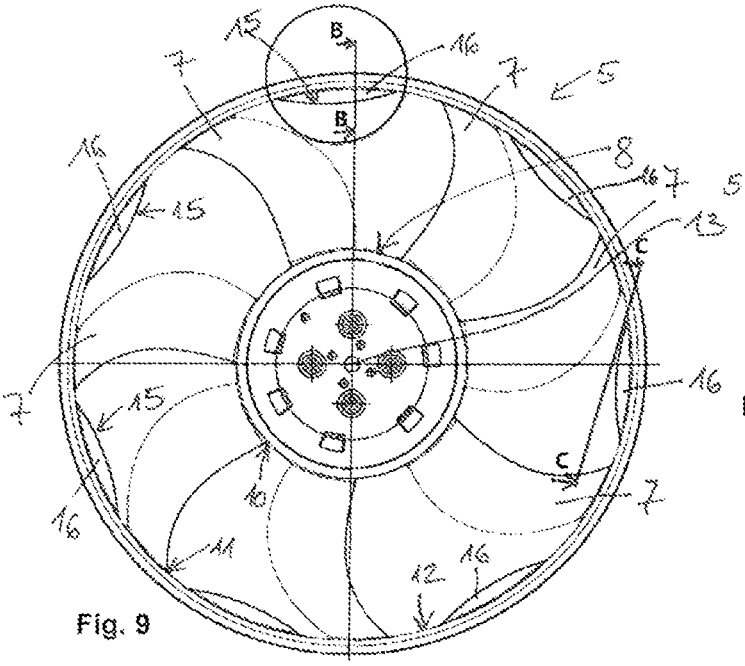
FIG. 9 is a front view of the fan impeller according to FIG. 8.

FIG. 8 is a simplified rear view of a fan impeller 5 according to an embodiment of the invention and FIG. 9 is a simplified front view of this fan impeller 5. The fan impeller 5 according to FIGS. 8 and 9 has the same structure as the fan impeller according to FIGS. 2, 4, 5 and 6. Therefore, reference is made in this regard to the description of the fan impeller in particular relating to FIGS. 2, 4, 5 and 6 and furthermore to the description relating to FIG. 3, in order to avoid unnecessary repetition. The fan impeller 5 shown in FIGS. 8 to 14 can likewise be inserted into the radiator fan module 1 previously shown in FIG. 1.

The fan impeller 5 according to FIGS. 8 and 9 differs from the fan impeller shown in FIGS. 2 and 4 to 6 merely on account of the lower number of fan impeller blades 7 and the detailed illustration of the hub 8. The design of the hub 8 of the fan impeller 5 according to FIGS. 8 and 9 is only an example, however, and may have any other design suitable for the hub of a fan impeller. Likewise, the fan impeller 5 according to the invention may have any number of fan impeller blades 7, depending on the function and purpose. The number of fan impeller blades in the drawings is only an example, and the fan impeller according to the invention may have more or fewer fan impeller blades than shown in the drawings.

In FIG. 8, as previously stated, the fan impeller 5 is shown from its front side 6, from which point air is drawn in via the fan impeller 5, as is previously the case for the fan impeller shown in FIG. 1.

The fan impeller blades 7 of the fan impeller 5 each extend outwards from the hub 8, i.e. outwards in the radial direction. Here, the hub 8 is connected to a fan impeller outer ring 9 via the fan impeller blades 7. Here, the fan impeller blades 7 are each connected to the hub 8 at the inner end 10 thereof and to the fan impeller outer ring 9, and in particular to its underside 12, at the outer end 11 thereof.

A motor may be provided in the hub 8 that drives the fan impeller 5 such that it rotates about its longitudinal axis 13 as a rotational axis. Here, with its fan impeller outer ring 9 and the frame, the fan impeller 5 forms a gap through which air drawn in through the radiator fan module on the front side of the fan impeller 5 can flow back. An example of a gap of this kind between a fan impeller outer ring and a frame has been shown previously by way of example in FIG. 3 in sectional views.

In the fan impeller 5 according to the invention, as shown by way of example in FIGS. 8 and 9, additional projections 15 are provided on the underside of the fan impeller outer ring 12. The projections 15 are in the form of flow fins 16 or flow ribs. In this case, the projections in the form of flow fins 16 or flow ribs are provided between the fan impeller blades 7 on the fan impeller blade outer ring 9. In the embodiment shown in FIGS. 8 and 9, at least one flow fin 16 or flow rib is provided e.g. between each two adjacent fan impeller blades 7 of the fan impeller 5; however, as previously described with reference to FIG. 2-6, a plurality of or at least two flow fins may also be arranged between two adjacent fan impeller blades.

Figure 12:
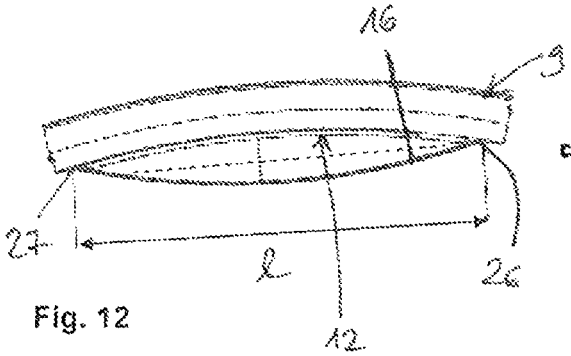
FIG. 12 shows a detail of a flow fin of the fan impeller according to FIG. 8.
Figure 13:
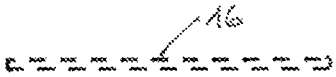
FIG. 13 is a simplified cross section through a flow fin of the fan impeller according to FIG. 8.
Figure 14:
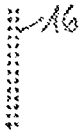
FIG. 14 is another simplified cross section through the flow fin according to FIG. 13.

FIG. 10 is a sectional view B-B of the fan impeller 5 in FIG. 9 through the fan impeller outer ring 12 thereof and one of the flow fins 16 thereof. Furthermore, FIG. 11 is a view of another flow fin 16 of the fan impeller according to FIG. 9 from below and viewed in the direction of the fan impeller outer ring 12. FIG. 12 in turn shows a detail of one of the flow fins of the fan impeller according to FIG. 9. FIGS. 13 and 14 show different cross sections of the flow fins 16 according to FIG. 12, with the cross section of the flow fin 16 in FIG. 12 indicated by a dotted line corresponding to the rectangular cross section in FIG. 13 and the cross section of the flow fin 16 in FIG. 12 indicated by a dashed line corresponding to the rectangular cross section in FIG. 14.

Owing to the flow fins 16, 16*, the reverse flow through the gap between the fan impeller outer ring 9 and the frame is deflected such that it merges with the main flow in a manner that is as free of turbulence as possible. As a result, such a fan impeller 5 according to the invention can significantly reduce noise in a radiator fan module.

In the embodiment shown in FIGS. 8 to 14, and in the subsequent embodiments in FIGS. 15 to 18, the flow fins 16, 16* do not have an aerodynamic profile, and thus are not additional fan blades 7. In other words, by contrast with the fan impeller blades 7, the flow fins 16, 16* do not have an aerodynamic profile.

The flow fins 16, 16* as shown in FIG. 8-18 and previously in FIG. 2-6, are instead designed as plates which are not convex but are flat or planar, by contrast with the convex fan impeller blade shown previously e.g. in FIG. 5. Accordingly, each flow fin 16 has a constant thickness. In an embodiment of the invention that is not shown, it is however conceivable for at least one of the flow fins to have at least one portion in which the thickness of the flow fin is not constant, but varies. For example, the outer edge of the flow fin may be rounded. Nevertheless, in this case the flow fins have a flat or planar structure, similarly to the flow fins shown in the drawings.

The shape and/or dimensions of the flow fins of the relevant fan impeller may be identical, as in the fan impeller 5 in FIGS. 8 to 14. In principle, instead of identical flow fins 16 as in the fan impeller 5 e.g. in FIGS. 8 to 14, a fan impeller 5 according to the invention can also have different flow fins 16, which differ for example in terms of their shape and/or dimensions. For example, flow fins 16 as shown in FIGS. 12 to 18 are combined with one another in a fan impeller.

The flow fins 16, 16* as shown in FIGS. 2-6 and 8-18 aim to improve the acoustics, and the geometry thereof does not have an aerodynamic profile. Therefore, said fins do not increase the torque of the fan impeller 5, or only increase it marginally. The aerodynamic efficiency also remains unchanged or substantially unchanged. Therefore, the acoustics of the radiator fan module can be improved by such a fan impeller 5 according to the invention without any negative impact on the aerodynamic properties of the fan impeller 5.

In an embodiment of the fan impeller 5 according to the invention shown by way of example in FIG. 8, a ratio of the height h of the flow fin 16 to the length l of the flow fin 16 is in a range of preferably $5\% < h/l < 25\%$. In this range, a particularly good result can be achieved in terms of acoustic effect, while at the same time having low material consumption and low weight owing to the flow fins being provided. However, the invention is not limited to this preferred range. In principle, the ratio h/I may be selected to be less than or equal to 5% or the ratio h/I may be selected to be greater than or equal to 25%, depending on the function and purpose.

In another embodiment of the fan impeller 5 according to the invention shown by way of example in FIG. 8, a ratio of the height h of the flow fin 16 to the spacing H of the fan impeller outer ring 9 is in a range of preferably 3%<h/H<20%. In this range, a particularly good result can likewise be achieved in terms of acoustic effect, while at the same time having low material consumption and low weight owing to the flow fins being provided.

As shown in FIG. 8, the height h of the flow fin 16 is measured in this case from the underside 12 of the fan impeller outer ring 9, to which each flow fin 16 is attached, to the highest point of the flow fin 16.

The spacing H of the fan impeller outer ring 9 is in turn measured from the underside 12 of the fan impeller outer ring 9 to the outside of the hub 8.

However, the invention is not limited to this preferred range. In principle, the ratio h/H may be selected to be less than or equal to 3% or the ratio h/H may be selected to be greater than or equal to 20%, depending on the function and purpose.

By contrast with the curved contour of the flow fin 16, as shown in FIG. 8-14 and previously e.g. in FIGS. 2 and 4 to 6, the flow fin 16 may also have other shapes or contours, as shown in the embodiments in FIGS. 15 to 18 that follow.

The flow fin in FIG. 12 has a curved contour in which the height of the flow fin 16 at a first end 26 e.g. increases from zero to a maximum height h and then decreases to a height of zero again, for example, up to its other or second end 27.

Figure 15:
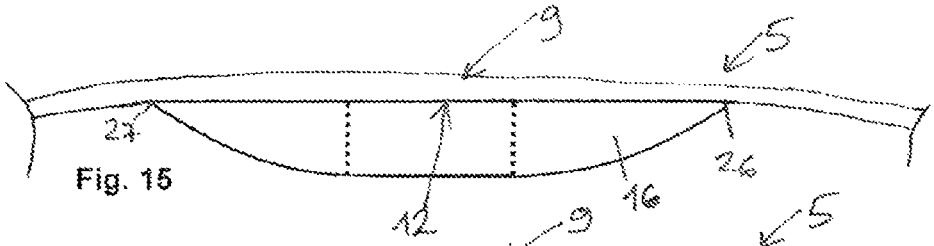
FIG. 15 shows a detail of another embodiment of a flow fin as may be provided in the fan impeller according to FIGS. 2 to 6 and FIGS. 8 to 14.

FIG. 15 shows a detail of another embodiment of a flow fin 16 as may be provided on the underside 12 of the fan impeller outer ring 9 of the fan impeller 5 according to the invention in FIGS. 2 to 6 and FIGS. 8 to 14.

In this case, the flow fin 16 likewise has a curved contour, but the height of the flow fin 16 likewise initially increases to a maximum height h from the first end 26, and then remains constant in an adjacent region, in order to then decrease to a height of e.g. zero again up to its other second end 27.

Figure 16:
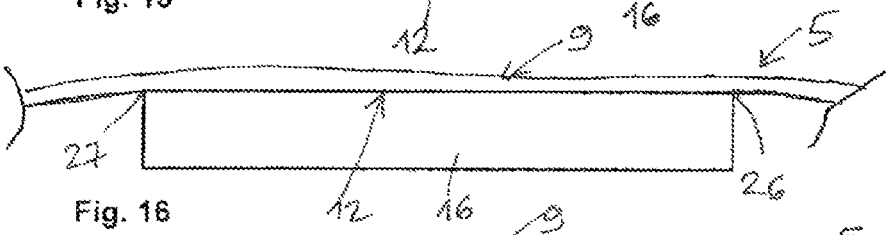
FIG. 16 shows a detail of a different embodiment of a flow fin as may be provided in the fan impeller according to FIGS. 2 to 6 and FIGS. 8 to 14.

FIG. 16 shows a detail of another embodiment of a flow fin 16 as may be provided on the underside 12 of the fan impeller outer ring 9 of the fan impeller 5 according to the invention in FIGS. 2 to 6 and FIGS. 8 to 14. In this case, the flow fin 16 has a rectangular contour. The flow fin 16 has a constant height h from the first end 26 thereof to the second end 27 thereof.

Figure 17:
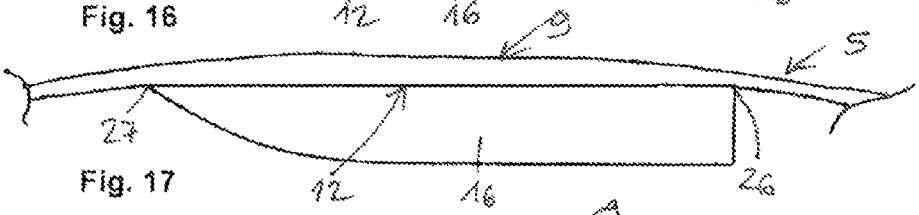
FIG. 17 shows a detail of another embodiment of a flow fin as may be provided in the fan impeller according to FIGS. 2 to 6 and FIGS. 8 to 14.

FIG. 17 shows a detail of another embodiment of a flow fin 16 as may be provided on the underside 12 of the fan impeller outer ring 9 of the fan impeller 5 according to the invention in FIGS. 2 to 6 and FIGS. 8 to 14. In this case, the flow fin 16 has a curved portion and a rectangular portion. In this case, instead of a height of zero, the flow fin 16 for example now has a maximum height h at the first end 26 thereof, with the height initially remaining constant e.g. as far as the centre of the flow fin 16 before the height of the flow fin decreases again up to the other or second end 27 thereof, e.g. continuously decreases to zero, for example.

Figure 18:
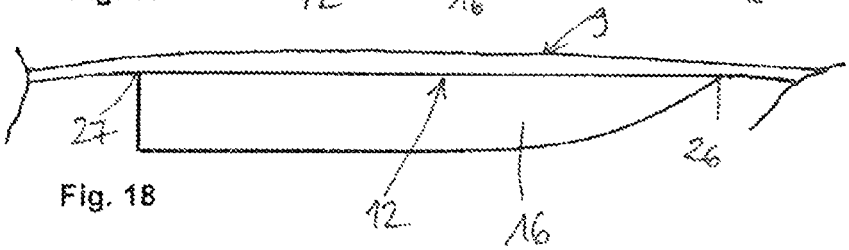
FIG. 18 shows a detail of yet another embodiment of a flow fin as may be provided in the fan impeller according to FIGS. 2 to 6 and FIGS. 8 to 14.

FIG. 18 shows a detail of yet another embodiment of a flow fin 16 as may be provided on the underside 12 of the fan impeller outer ring 9 of the fan impeller 5 according to the invention in FIGS. 2 to 6 and FIGS. 8 to 14. In this case, the flow fin 16 likewise has a curved portion and a rectangular portion. In this case, the flow fin 16 increases, e.g. continuously, to the maximum height h thereof for example to the centre from a height of e.g. zero from the first end 26 thereof, and then the height thereof remains constant up to the other or second end 26 thereof.

The progression of the contours of the flow fins 16 of the impeller 5 according to the invention in FIGS. 2 to 6 and 8 to 18 is only given by way of example, and the invention is not restricted to these specific examples. The contour may be designed in any way, depending on the function and purpose.

Although the present invention has hitherto been described entirely by way of preferred embodiments, it is not restricted thereto, but can be modified in various ways. The fan impeller according to the invention, as shown in FIGS. 2 to 6 and 8 to 18, may be designed as a fan impeller comprising unsickled fan impeller blades or as a fan impeller comprising forward-sickled fan impeller blades or as a fan impeller comprising backward-sickled fan impeller blades, depending on the function and purpose.

LIST OF REFERENCE SIGNS

1 radiator fan module
2 fan impeller
3 frame
5 fan impeller according to the invention
6 front side of the fan impeller
7 fan impeller blades
8 hub
9 fan impeller outer ring
10 inner end (fan impeller blades)
11 outer end (fan impeller blades)
12 underside
13 longitudinal axis
14 gap
15 projection
16 flow fin
17 opening (frame)
18 first portion
19 second portion
20 circle
21 curve of the conventional fan impeller
22 curve of the fan impeller according to the invention
23 curve of a fan assembly of the conventional fan impeller
24 curve of a fan assembly of the fan impeller according to the invention
25 rear side of the fan impeller
26 first end (flow fin)
27 second end (flow fin)

The invention claimed is:

1. A fan impeller for a radiator fan module of a motor vehicle, the fan impeller comprising:

a hub, a fan impeller outer ring, a plurality of fan impeller blades, which extend outwards from the hub and are interconnected by the fan impeller outer ring, and a plurality of flow fins, which are arranged on the underside of the fan impeller outer ring between the fan impeller blades, wherein the fan impeller blades each have an inner end and an outer end, the fan impeller blades each being arranged on the hub at the inner end thereof and on the underside of the fan impeller outer ring at the outer end thereof, wherein at least one of the flow fins and the outer ends of the fan impeller blades are arranged on a common line in the circumferential direction of the fan impeller outer ring, wherein when both the flow fins and the fan impeller blades are arranged on a common line, the flow fins and the outer ends of the fan impeller blades are arranged on the same common line or the flow fins are arranged on a common line different from a common line of the fan impeller blades.

2. The fan impeller of claim 1, wherein at least one flow fin is arranged between two adjacent fan impeller blades.

3. The fan impeller of claim 2, wherein the at least one flow fin does not overlap at least in part with either of the two adjacent fan impeller blades.

4. The fan impeller of claim 1, wherein the flow fins are arranged in the circumferential direction of the fan impeller outer ring.

5. The fan impeller of claim 1, wherein the fan impeller is a fan impeller having non-sickled fan impeller blades or a fan impeller having forward-sickled fan impeller blades or a fan impeller having backward-sickled fan impeller blades.

6. The fan impeller of claim 1, wherein the fan impeller is integrally formed as an injection-moulded part.

7. The fan impeller of claim 1, wherein, the flow fins or a combination of the fan impeller outer ring and the flow fins are fastened to the rest of the fan impeller as a separate component.

8. The fan impeller of claim 1, wherein each flow fin is designed as a flat plate having a constant thickness.

9. The fan impeller of claim 1, wherein the ratio of the height of each flow fin to the length of the flow fin is in a range of between $5\% < h/I < 25\%$.

10. The fan impeller of claim 1, wherein the ratio of the height of each flow fin to the spacing of the fan impeller outer ring from the outside of the hub is in a range of $3\% < h/H < 20\%$.

11. The fan impeller of claim 1, wherein each flow fin has a curved contour or at least one curved portion.

12. The fan impeller of claim 1, wherein each flow fin has a rectangular contour or at least one rectangular portion.

13. A radiator fan module, the radiator fan module comprising:

a fan impeller for a radiator fan module of a motor vehicle, the fan impeller comprising: a hub, a fan impeller outer ring, a plurality of fan impeller blades, which extend outwards from the hub and are interconnected by the fan impeller outer ring, and a plurality of flow fins, which are arranged on the underside of the fan impeller outer ring between the fan impeller blades, wherein the fan impeller blades each have an inner end and an outer end, the fan impeller blades each being arranged on the hub at the inner end thereof and on the underside of the fan impeller outer ring at the outer end thereof, wherein at least one of the flow fins and the outer ends of the fan impeller blades are arranged on a common line in the circumferential direction of the fan impeller outer ring.

14. The radiator fan module of claim 13, wherein the radiator fan module has a structure in which struts of a frame of the radiator fan module are provided in front of the fan impeller in the vehicle direction.

15. The radiator fan module of claim 13, wherein the radiator fan module has a structure in which struts of a frame of the radiator fan module are arranged behind the fan impeller in the vehicle direction.

16. The radiator fan module of claim 13, wherein the gap geometry of a gap formed between a frame and the fan impeller outer ring is designed to at least reduce a swirling reverse flow through the gap.

* * * * *